United States Patent [19]

Stauss et al.

[11] Patent Number: 4,593,498

[45] Date of Patent: Jun. 10, 1986

[54] CONSTRUCTION COMPONENT FOR PRODUCING OF PREFERRED SHOT-IN STRUCTURES

[75] Inventors: Eberhard Stauss, Munich; Hans-Rudolf Klein, Berg; Alfons Thalmeir, Munich, all of Fed. Rep. of Germany

[73] Assignee: Dyckerhoff & Widmann AG, München-Reim, Fed. Rep. of Germany

[21] Appl. No.: 691,159

[22] Filed: Jan. 14, 1985

[30] Foreign Application Priority Data

Jan. 17, 1984 [DE] Fed. Rep. of Germany ... 8401113[U]
Jul. 16, 1984 [DE] Fed. Rep. of Germany ..... 3426119

[51] Int. Cl.[4] ..... E04B 7/12

[52] U.S. Cl. ..... 52/18; 52/79.1; 52/79.7; 52/234

[58] Field of Search ..... 52/18, 79.1, 79.8, 79.9, 52/79.11, 227, 234, 200, 639, 643, 79.7; 47/17

[56] References Cited

U.S. PATENT DOCUMENTS

| | | | |
|---|---|---|---|
| D. 236,461 | 8/1975 | Fairburn | 52/236.1 |
| 1,321,426 | 11/1919 | Estrada | 52/18 |
| 2,604,670 | 7/1952 | Horowitz | 52/200 |
| 2,645,114 | 7/1953 | Amirikian | 52/236.1 |
| 3,564,795 | 2/1971 | Henton | 52/227 |
| 3,566,554 | 3/1971 | Schaffer et al. | 52/234 |
| 3,605,351 | 9/1971 | Vredevoogd | 52/234 |
| 3,897,662 | 8/1975 | Fencl | 52/227 |
| 3,999,355 | 12/1976 | Stucky | 52/227 |
| 4,059,931 | 11/1977 | Mongan | 52/227 |
| 4,194,339 | 3/1980 | Fisher | 52/79.9 |
| 4,387,760 | 6/1983 | Greschbach | 160/229 R |

FOREIGN PATENT DOCUMENTS 1759242 3/1976 Fed. Rep. of Germany .

*Primary Examiner*—John E. Murtagh
*Assistant Examiner*—Andrew Joseph Rudy
*Attorney, Agent, or Firm*—Max Fogiel

[57] ABSTRACT

A kit of components a structure consists of a basic element (3) consisting, in the form of a hollow structural section like a cellular space with a rectangular cross-section, of two parallel side walls (1*a*) and of a floor slab (1*b*) and roof slab (1*c*), leaving two openings (3*b*), of a two-part folding door (6) that can be set into one of the two opening to constitute a front element, that can be fitted against each vertical side of the opening, and that consists at least partly of light-permeable material, each part of which has at least two wings that can be swung around axes parallel to the vertical front side, whereby the folding door (6) does not when it is open and folded back toward the two vertical front sides extend into the interior of the cellular space. There is also a rear element (2) that corresponds in cross-section to the basic element, that is covered like a box by a rear wall (2*d*), that can be erected, in order to create the structure, with its opening (2*b*) aligned with an opening in the basic element 3 or front element 1, with a gap in between if desirable. Finally, there belongs to the kit an illumination element (12 or 13) that can be employed for installation in the gap between two elements and that consists in the vicinity of the side wall and/or roof slab at least partly of light-permeable material.

11 Claims, 9 Drawing Figures

CONSTRUCTION COMPONENT FOR PRODUCING OF PREFERRED SHOT-IN STRUCTURES

Figure 1:
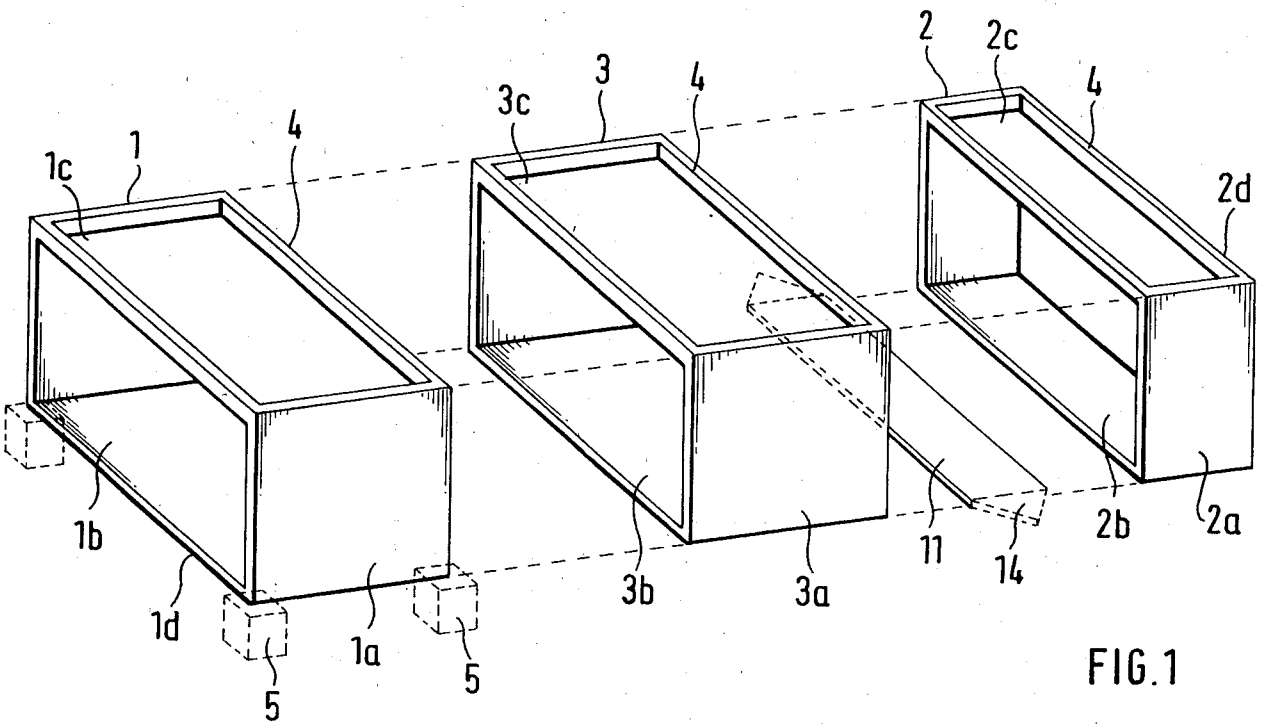

The manufacture of cellular modules in the form of prefabricated steel-reinforced concrete components that are produced in appropriate pouring forms at the factory and transported to the site in appropriate vehicles for utilization as automobile garages is known.

The use of prefabricated concrete components that are equal in height and depth and differ only in length, that not only demarcate the space but also perform the function of the supporting framework of an overall structure, and that can be positioned in various combinations next to, behind, and on top of one another to create the structure is also known in erection of edifices (German Pat. No. 1 759 242).

Developments in business and economics have led in our employment society on the one hand to more and more disposable free time and its utilization and exploitation through sports, hobbies, do-it-yourself activities, etc. and on the other, as the result of developments in prices, to smaller and smaller dwellings with insufficient space for such activities or to accommodate the devices, equipment, and articles necessary for them.

The object of the invention is to provide a kit of components of the aforesaid generic type for these contradictory developments that will nevertheless allow the increasing free-time activities to be carried out in the immediate vicinity of one's residence and that structures adapted to individual requirements can easily and economically be erected with in a wide range of variations.

This object is attained in accordance with the invention with a set of components in accordance with the preamble to the major claim and by means of the characteristics presented in its body.

The design of the terminal and basic element, which can be utilized in conjunction with the glazed folding door, allows a large number of potential combinations, Add to this that the folding door consists of light-permeable material and that the illumination element allows daylight illumination, which matches the structure to almost any need. Thus, the structure functions not only for garaging automobiles or storing sports and gardening equipment but also as a hobby, fitness, or music room, and as a workshop, kiosk, video center, or vacation house.

The folding door employed not only has an esthetically pleasing shape when closed but frees almost the total cross-section of the structure when open. Furthermore, the folding door extends with no additional design component into the structure.

A structure based on known prefabricated steel-reinforced concrete garages but deviating from the long-practiced longitudinal format can now be erected in accordance with the invention from at least two elements positioned one behind the other transverse to the length of the structure and still conforming more or less in shape and dimensions to the known prefabricated garages, so that they can be manufactured and transported with the equipment already available for that purpose. Erection itself is just as simple, requiring no mortar.

Practical embodiments and developments of the invention are characterized in the subsidiary claims.

Figure 2:
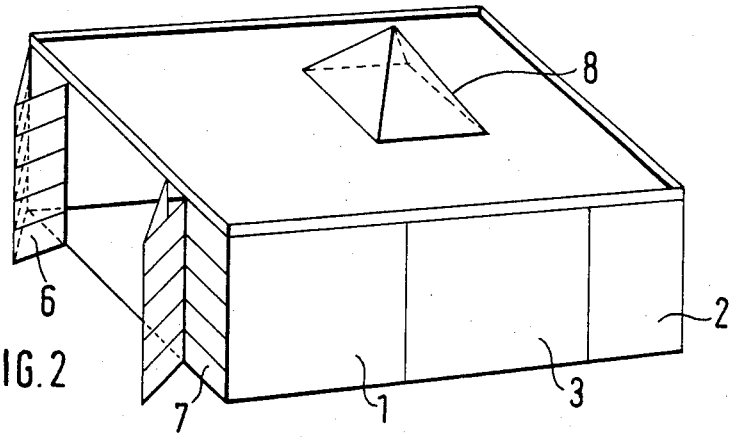
Figure 3:
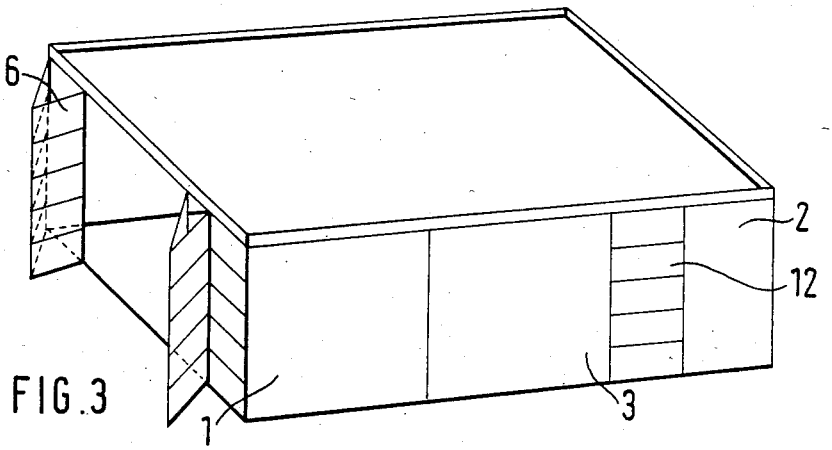
Figure 4:
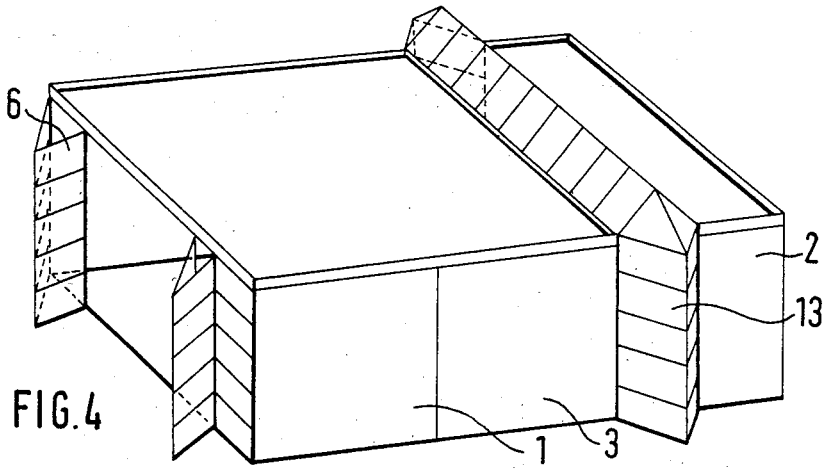
Figure 6:
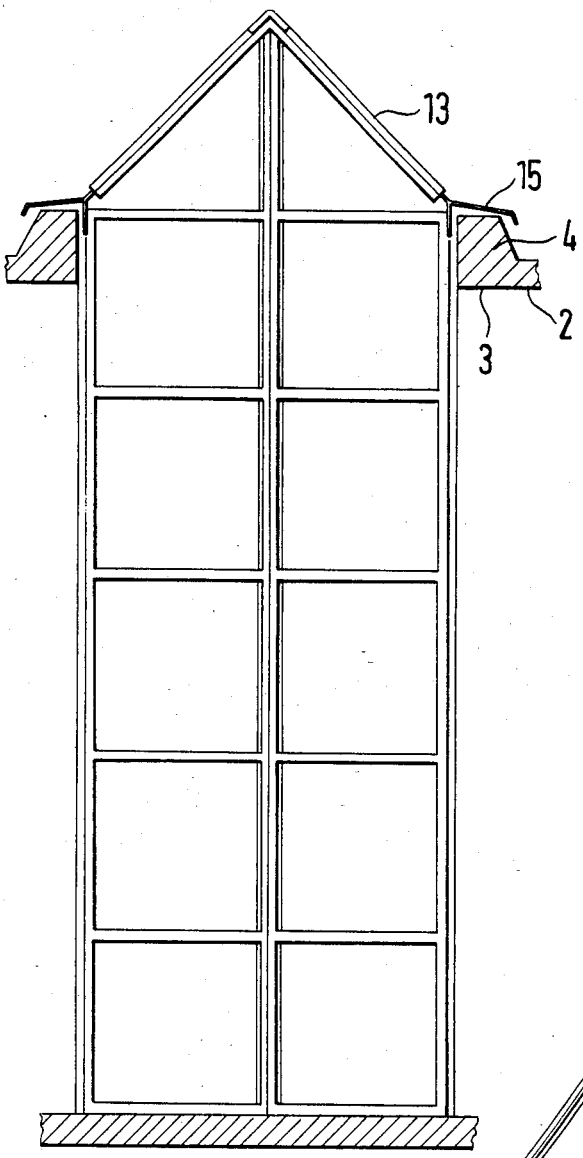
Figure 5:
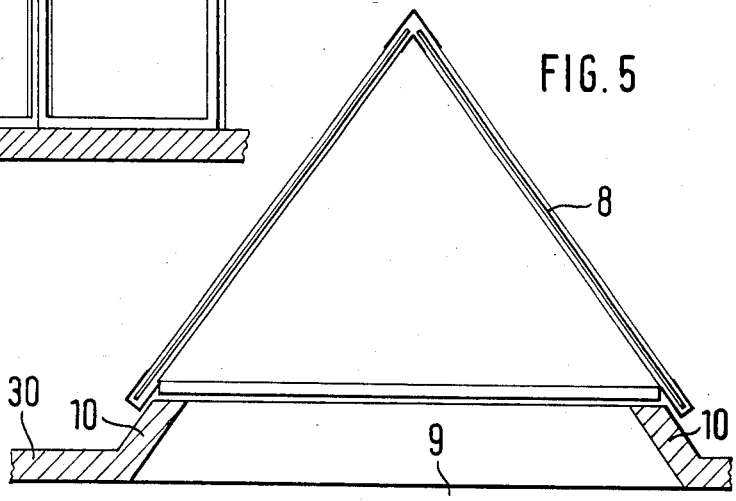
Figure 7:
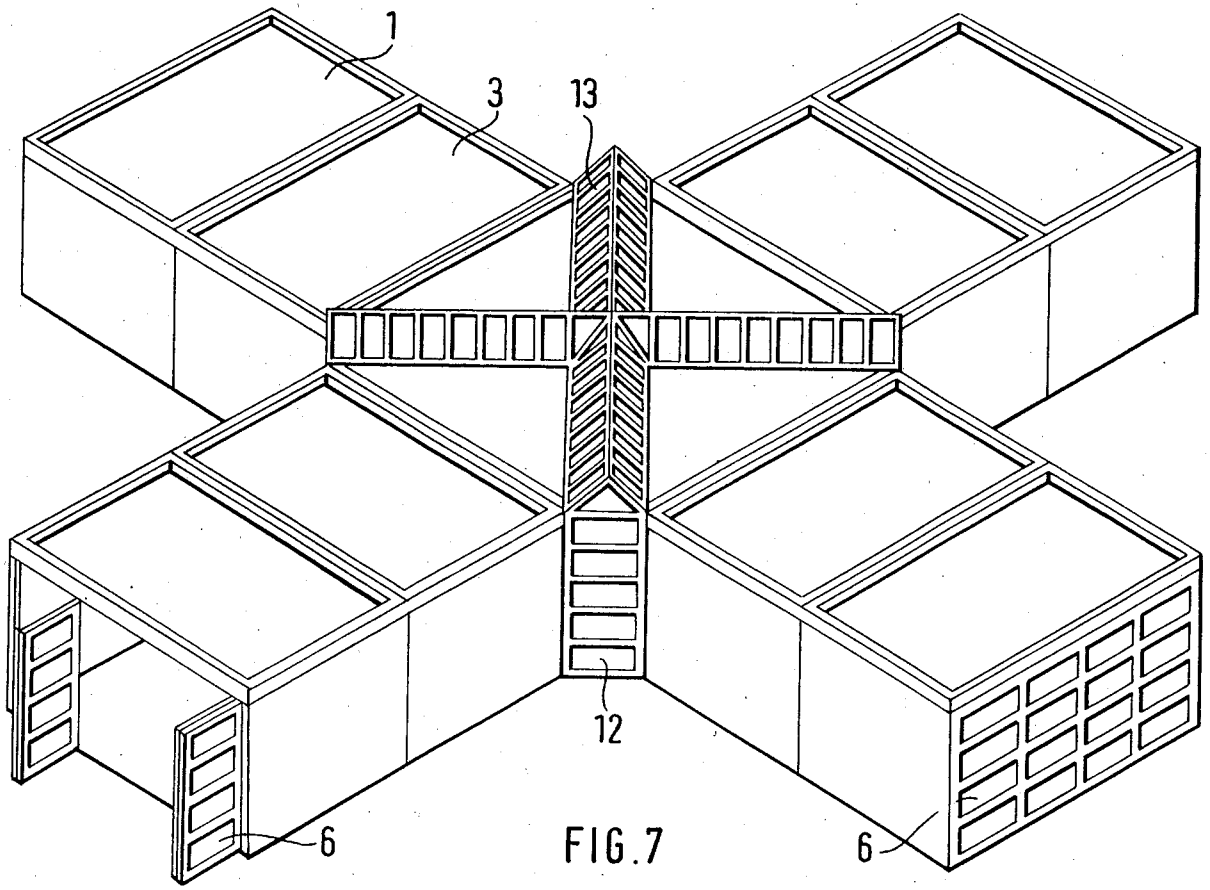
Figure 8:
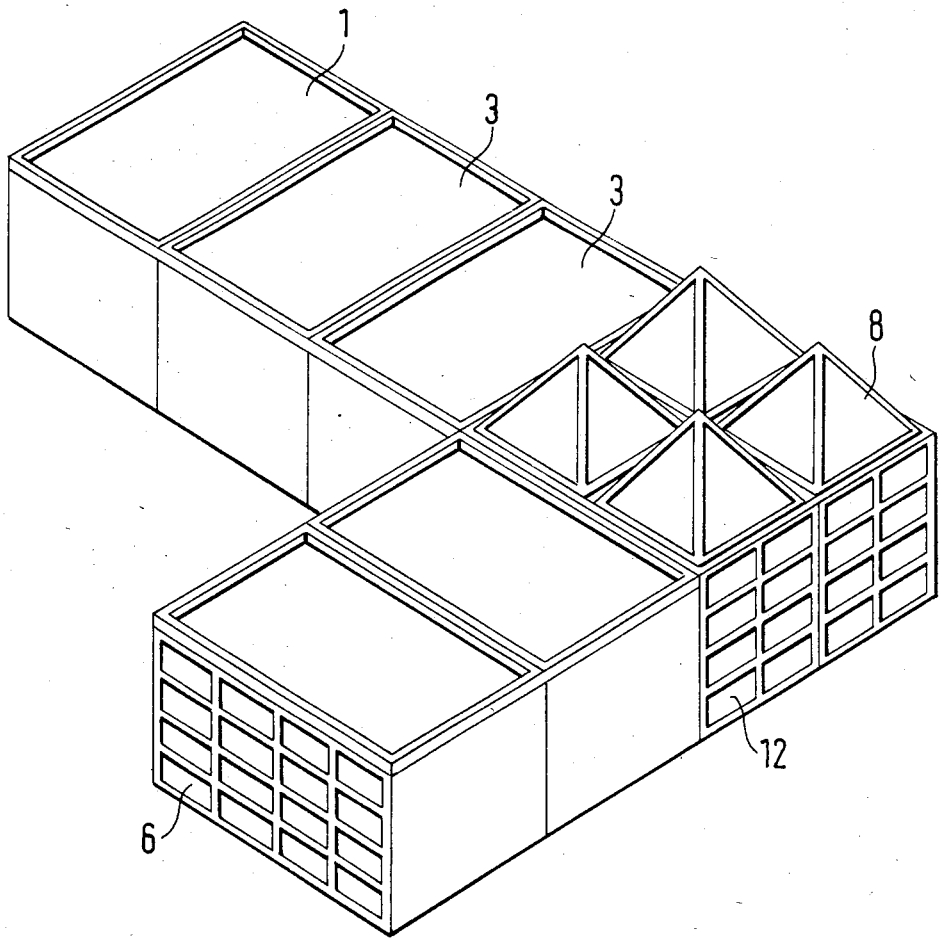
Figure 9:
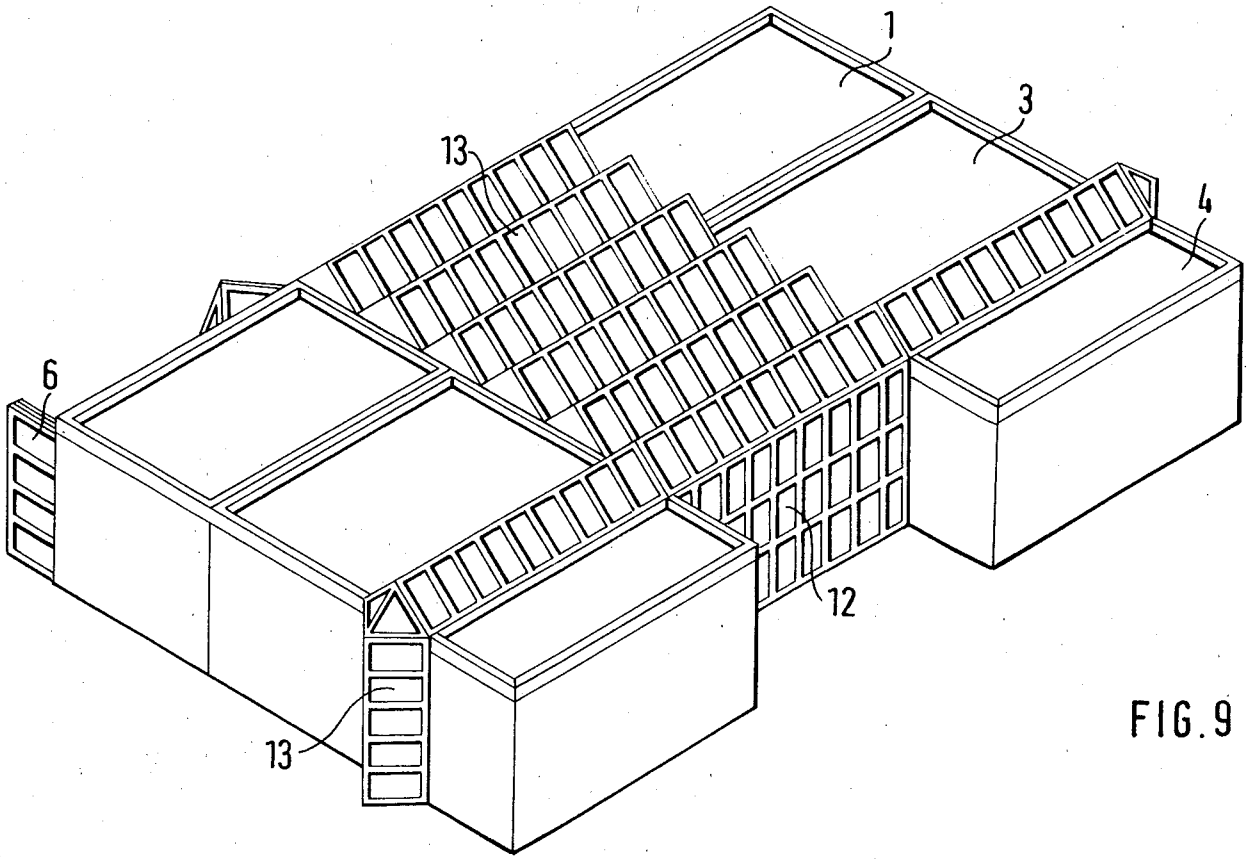

A preferred embodiment of the invention will now be explicated in detail with reference to the drawing, wherein FIG. 1 is an exploded general view of the components of the kit, FIGS. 2 through 4 are perspective views of structures erected from the components, FIG. 5 illustrates an illumination pyramid of the type illustrated in FIG. 2 applied to the roof slab of one component, FIG. 6 an illumination element of the type illustrated in FIG. 4 and covering the gap between two other elements, and FIGS. 7 through 9 further embodiments of a structure erected from the components.

For erecting the basic structure in the perspective illustration in FIG. 1 the kit in accordance with the innovation comprises three components, a front element 1, a rear element 2, and an intermediate element 3. Each of these elements consists of side walls 1*a*, 2*a*, and 3*a*, of a floor slab 1*b*, 2*b*, and 3*b*, and of a roof slab 1*c*, 2*c*, and 3*c*. The rear of rear element 2 is covered by a rear wall 2*d*. The front 1*d* of front element 1 has an opening and can be closed off with a light-permeable folding door. All elements 1, 2, and 3 have reinforcements 4 around their upper edges in the form of covers that do not affect the free interior space or its rectangular cross-section.

The front element in FIG. 1 rests on individual foundations 5 represented by broken lines. Intermediate element 3 is immediately adjacent to front element 1, and rear element 2 to intermediate element 3. Each individual foundation 5 is large enough to accommodate two adjacent elements. Corresponding foundations must of course be positioned under the joint between intermediate element 3 and rear element 2.

FIG. 2 illustrates a structure consisting of a front element 1, a rear element 2, and an intermediate element 3. The front can be closed off with a folding door 6, which can if desired incorporate a stationary part 7.

Folding door 6 is in two parts and is fitted at each vertical side of opening lb with each part. Each part consists of at least two wings that swing on vertical and parallel axes. When folding door 6 is open, each part is folded together to one side in such a way that the door does not extend into the free cross-section of the structure.

In the roof slab of intermediate element 3 is an illumination element 8 in the form of an illumination pyramid that allows daylight into the structure. FIG. 5 is a detailed cross-section of the pyramid. There is an aperture 9 in the roof slab 3*c* of element 3 with a sloping turn-up 10 at the edge, on which component 8 is mounted in the form of a quadrilateral pyramid.

In another embodiment of the kit of components it is possible for instance to position rear element 2 at a prescribed interval from intermediate element 3 as already implied in FIG. 1. The interval can be covered over in the vicinity of floor slabs 2*b* or 3*b* by an intermediate slab 11, which also rests on foundations, not illustrated, associated with individual foundations 5. An intermediate plate can also be similarly positioned in the vicinity of roof slabs 2*c* or 3*c*. The intermediate plates can as illustrated in FIG. 1 be finished separately and layed in place or cast onto the floor or roof plates of the adjacent elements, of rear element 2 for example. Window elements of a light-permeable material can be positioned in the vicinity of the surfaces of the walls of the structure. A structure of this type is illustrated isometrically in FIG. 3, with the window lying within the plane of the outer surface here as well.

To improve the illumination of the interior of the structure even more there are illumination elements in the form of what is called an illumination ridge, which has a cross-section that projects beyond the outline of the structure. A structure with an illumination ridge 13 of this type is illustrated in FIG. 4. To match it, the intermediate plate 11 in the vicinity of the floor (FIG. 1) has triangular ends 14 that the upright elements of the illumination ridge are set against. FIG. 6 is a section through an illumination ridge. This figure shows how the roof element, triangular in section, of the illumination ridge is positioned on the edge reinforcements 4 of adjacent elements 2 and 3 with lateral positioning parts 15.

We claim:

1. A kit of components for erecting single-story structures and consisting of prefabricated concrete components that demarcate a space and perform a supporting function, comprising: a basic element with a hollow structural section having a cellular space with a rectangular cross-section, two parallel side walls, a floor slab, a roof slab, and two openings; a two-part folding door set into one of said two openings to comprise a front element fitted against each vertical side of the opening; said door being comprised at least partly of light-permeable material; each part of said door having at least two wings that can be swung around axes parallel to a vertical front side; said folding door not extending into and interior of said cellular space when said door is open and folded back toward the two vertical front sides; a rear element corresponding in cross-section to said basic element and covered box-like by a rear wall that can be erected to create a structure; said rear wall having an opening aligned with one of the two openings in said basic element with a gap therebetween; and an illumination element located in a gap between the basic element and rear element, and comprised at least partly of light-permeable material in a vicinity of a side wall and roof slab; said illumination element and said folding door comprising two light transmitting sources.

2. A kit of components as defined in claim 1, wherein said roof slab of said basic element has an aperture covered with an illumination element of light-permeable material.

3. A kit of components as defined in claim 1, wherein at least one basic element is positionable as an intermediate element between said front element and said rear element.

4. A kit of components as defined in claim 1, wherein said elements have facing fronts with longitudinal grooves for insertion of sealing strips.

5. A kit of components as defined in claim 1, wherein said rear element and said basic element are positioned in spaced relationship with a gap therebetween, said gap being closed off with components comprised at least partly of light-permeable material in vicinity of wall surfaces.

6. A kit of components as defined in claim 5, wherein said gap is closed off by slab-shaped components of steel-reinforced concrete in vicinity of floor slabs and roof slabs of said elements.

7. A kit of components as defined in claim 5, wherein components of light-permeable material have a triangular cross-section with a base lying in an outer surface of the structure and projecting also beyond an outline of the structure.

8. A kit of components as defined in claim 5, wherein slab-like components are comprised as one piece with associated slabs of one of adjacent elements.

9. A kit of components as defined in claim 1, including reinforcements on said elements around outer edges of roof slabs in form of covers.

10. A kit of components as defined in claim 2, wherein said aperture has turn-up edges for positioning an illumination element thereon.

11. A kit of components as defined in claim 1, wherein said front element has a roof slab projecting to said folding door.

* * * * *